United States Patent [19]

Hirayama et al.

[11] Patent Number: 4,570,558

[45] Date of Patent: Feb. 18, 1986

[54] OVERLOCK SEWING MACHINE HAVING LOOPING WIDTH ADJUSTING MECHANISM

[75] Inventors: Tetsuro Hirayama, Chofu; Masayuki Oikawa, Niiza; Ichirou Horie, Fujimi, all of Japan

[73] Assignee: Juki Co., Ltd., Tokyo, Japan

[21] Appl. No.: 546,835

[22] Filed: Oct. 31, 1983

[30] Foreign Application Priority Data

| | | | |
|---|---|---|---|
| Oct. 29, 1982 | [JP] | Japan | 57-164298[U] |
| Nov. 30, 1982 | [JP] | Japan | 57-210494 |
| Aug. 24, 1983 | [JP] | Japan | 58-130921[U] |

[51] Int. Cl.[4] ..... D05B 1/20

[52] U.S. Cl. ..... 112/162; 112/315

[58] Field of Search ..... 112/162, 177, 315, 314

[56] References Cited

U.S. PATENT DOCUMENTS

| | | | |
|---|---|---|---|
| 3,009,430 | 11/1961 | Lutz et al. | 112/162 |
| 3,885,509 | 5/1975 | Cox | 112/162 |
| 4,205,616 | 6/1980 | Sugahara | 112/162 X |

FOREIGN PATENT DOCUMENTS

| | | |
|---|---|---|
| 146152 | of 1979 | Japan . |
| 78991 | of 1980 | Japan . |

*Primary Examiner*—H. Hampton Hunter

*Attorney, Agent, or Firm*—Basile Weintraub Hanlon

[57] ABSTRACT

An overlock sewing machine having a dial and a conversion means for converting the rotary motion of the dial into a linear motion which are associated with a cutter blade holder such that the adjustment of the distance between a stationary claw and a movable claw adjusts the looping width in correspondence with the linear movement of the cutter blade holder perpendicular to the direction of feed of the cloth caused by rotation of the dial. The movable claw, carried by a movable member, can move between an operative position in which the movable claw is positioned next to the side of the stationary claw and an inoperative position spaced away from the side of the stationary claw. The position at which the cutter blade holder is supported on the machine body is offset from the position at which the upper and lower cutting blades make contact. A spring-like resilient member is disposed between the throat plate or the machine body and the cutter blade holder or the lower cutter blade so as to upwardly or downwardly bias the cutter blade holder. An extension on either the stationary or movable claw is adapted to lap over the other claw to prevent the cloth from dropping into the gap between the two claws preventing any disorder in the seam.

12 Claims, 7 Drawing Figures

OVERLOCK SEWING MACHINE HAVING LOOPING WIDTH ADJUSTING MECHANISM

BACKGROUND OF THE INVENTION

I. Field of the Invention

The present invention relates to an overlock sewing machine having a looping width adjusting mechanism and, more particularly, to an overlock sewing machine of the type having a movable claw for adjusting the looping width and carried by a cutter blade holder together with the lower cutter blade of a cutter blade device, the cutter blade holder being adjustably mounted on the machine body. The machine further has a dial and a means for converting the rotation of the dial into the forward and backward movement of the cutter blade holder, wherein the movable claw is movable between an operative position and an inoperative position so that the machine can also perform so-called wrap-lock overlock sewing.

II. Description of the Prior Art

Overlock sewing machines are known which have a stationary claw for forming loops for overlock sewing, a movable claw arranged in a side-by-side fasion to one side of the stationary claw and movable toward and away from the aforesaid side, conversion means for converting operational rotary motion into linear motion for moving the movable claw, and a cutter blade mechanism with a lower cutter blade. This type of overlock sewing machine is shown, for example, in Japanese Laid-Open Application No. 78991/1980. This known overlock sewing machine, however, suffers from the following disadvantage. Namely, since the movable claw is secured to a thin needle plate, the movable claw tends to be oscillate in the vertical direction, i.e. in the direction of the cutter blade operation, due to the influence by cutter blade operation load during the sewing operation of the machine. In consequence, the loop diameter which is determined by the distance between the movable claw and the stationary claw fluctuates to incur a disorder in the seam to impair the appearance of the seam. The conventional overlock sewing machine, therefore, requires means for fixing the movable claw securely to the throat plate by means of, for example, bolts, besides the above-mentioned conversion means for converting the rotary motion into linear motion. Thus, in the conventional overlock sewing machine, it is necessary to mount, the conversion means for converting rotary motion into linear motion and fixing means for fixing the movable claw necessary to adjust looping width, on a thin and narrow throat plate. Such mounting is extremely difficult from requires two-step adjusting and fixing operation. Furthermore, in the conventional overlock sewing machine having the described construction, it is necessary to take off the cloth from the fixing means at each time the looping width is changed. In addition, this type of conventional overlock sewing machine can not perform a special sewing called wrap-lock sewing in which the looping is made in such a manner as to wrap the end of the cloth.

In order to cope with the demand for the wrap-lock sewing, an overlock sewing machine has been proposed in which the movable claw takes either an operative position where it is disposed in a side-by-side fashion to one side of the stationary claw and an inoperative position where it is offset from the stationary claw. In order to mount a means for moving the movable claw between the operative position and the inoperative position and to minimize the influence of the vibration, a block type cutter blade holder is mounted on the machine body by means of a guide so as to be able to move towards and away from the side of the stationary claw, and the movable claw is secured to this block type cutter blade holder. This type of overlock sewing machine is disclosed in, for example, Japanese Patent Publication No. 25875/1980.

In this sewing machine also, the adjustment is made by fingers nipping the cutter blade holder itself, and it is still necessary to fix the above-mentioned guide by a fixing means. Thus, this type of sewing machine still requires necessity for taking two independent steps of adjustment and fixing.

Japanese Laid-Open Application No. 146152/1979 discloses an overlock sewing machine in which the movable claw is secured to a throat plate as in the previously mentioned prior art and is adapted to be moved by a conversion means which converts a rotary motion into linear motion, and a rotary dial is attached to this conversion means. This overlock sewing machine, however, still requires means for fixing the movable claw against the vibration of the cutter blade mechanism and, therefore, the user could not fully enjoy the advantage of the provision of the rotary dial. Needless to say, due to the fact that the movable claw is secured to the throat plate, this known overlock sewing machine encounters a difficulty in adopting an arrangement which would permit the movable claw to move between the operative position where it is in a side-by-side relation to the side of the stationary claw and the inoperative position where it is offset from the side of the stationary claw.

The known overlock sewing machine described hereinbefore suffers from a common disadvantage that, when the movable claw is spaced away from the stationary claw, the cloth undesirably drops into the gap between the stationary claw and the movable claw particularly when the cloth has a comparatively small thickness, so that it is quite difficult to obtain attractive and precise overlock.

Under these circumstances, the present invention aims as its primary object at providing an overlock sewing machine which can overcome the above-described problems of the prior art.

More specifically, it is an object of the invention to provide an easily operable overlock sewing machine which is improved to permit a change in the looping width merely by a rotation of a dial and to eliminate the necessity for the fixing means or the like for fixing the movable claw against the vibration of the cutter blade mechanism.

Another object of the invention is to provide an overlock sewing machine which is improved to avoid the undesirable dropping of the cloth into the gap between the stationary claw and the movable claw which may occur when the sewing operation is conducted with a large looping width, thereby to ensure an attractive appearance of the overlock even when the thickness of the cloth is comparatively small.

Still another object of the invention is to provide an overlock sewing machine which can attain, in addition to the objects mentioned above, an additional function of wrap-lock sewing.

SUMMARY OF THE INVENTION

To these ends, according to an aspect of the invention, there is provided an overlock sewing machine comprising a stationary claw formed on the needle-side of a throat integrally with the latter so as to be directed in the cloth feeding direction, and a movable claw disposed in a side-by-side relation to the stationary claw so as to be able to move towards and away from the stationary claw. The movable claw is carried by a cutter blade holder which is held by the machine body through a guide for movement in the direction perpendicular to the direction of feed of the cloth.

According to this arrangement, the cutter blade holder which is thick-walled and rigid as compared with the throat plate can carry the means for moving and setting the movable claw between and at the operative position where it is juxtaposed to the stationary claw and the inoperative position spaced away from the same. More specifically, according to the invention, the movable claw is carried by a movable member which is movable along a guide groove formed in the side surface of the mes holder adjacent to the stationary claw. Holes or notches are formed at the ends of the stroke of the movable member which in turn resiliently supports a member engageable with the holes or notches, so that the movable member and, hence, the movable claw can be correctly positioned and set either at the operative position or the inoperative position mentioned above.

A conversion means for converting a rotary motion into a linear motion is associated with this cutter blade holder in such a manner that, as the rotary dial is rotated, the cutter blade holder together with the movable claw is moved towards and away from the stationary claw which is integral with the throat plate.

Since the guide member for carrying the cutter blade holder can incorporate one or more shafts having large cross-section and rigidly secured to the machine body, it is not necessary to employ any specific fixing device for fixing the movable claw against the vibration of the cutter blade mechanism.

In order to make sure of the fixation, a pointer constituted by a spring-like resilient member is fixed to the cutter blade holder and is extended to the reverse side of the throat plate so as to make a resilient contact with the latter, so that the cutter blade holder is biased in the direction perpendicular to the axis of the guide member by the reactional force produced by the pointer. At the same time, a transparent window for the lighting purpose is formed in the throat plate and a scale is provided in the transparent plate so that the pointer can be observed through the window and adjusted in relation to the scale.

In the overlock sewing machine of the invention, the lower cutter blade is supported by means of a cutter blade holder. The arrangement is such that, as the lower mes is supported obliquely along the path of feed of the cloth, the lower cutter blade is supported at the lower side of the upper end thereof by a cutter blade support portion formed on the throat plate. This arrangement conveniently decreases the load imposed on the cutter blade holder to attain a higher cutting performance of the cutter blade.

Either one of the stationary claw and the movable claw is provided at its upper end with an extension extended towards the other so as to support the cloth. This extension effectively prevents the cloth from falling into the gap between the stationary claw and the movable claw. The disorder of the seam, therefore, is avoided even when a large looping width is taken with thin cloth.

The extension provided on the movable claw or the stationary claw may cause an interference between the stationary claw and the movable claw during the movement of the latter between the operative position and the inoperative position to hinder the movement of the movable claw. In order to obviate such an interference, it is advisable to provide a pin or the like projection which moves into and out of engagement with the machine body or other stationary portion to ensure that, when the movable claw moves, it is necessarily spaced away from the stationary claw in the direction for increasing the looping width. According to this arrangement, when the movable claw takes a position near the stationary claw to make the extension engage with the stationary claw or the movable claw, the aforesaid extension engages with the machine body or other stationary part to prevent the movement of the movable claw.

DESCRIPTION OF THE PREFERRED EMBODIMENTS

Figure 6:
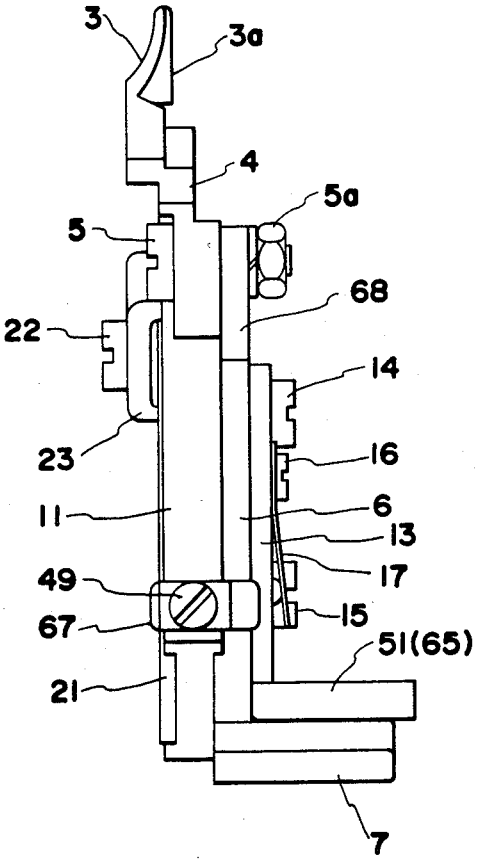
FIG. 6 is a view as viewed in the direction of an arrow E in FIG. 4.
Figure 7:
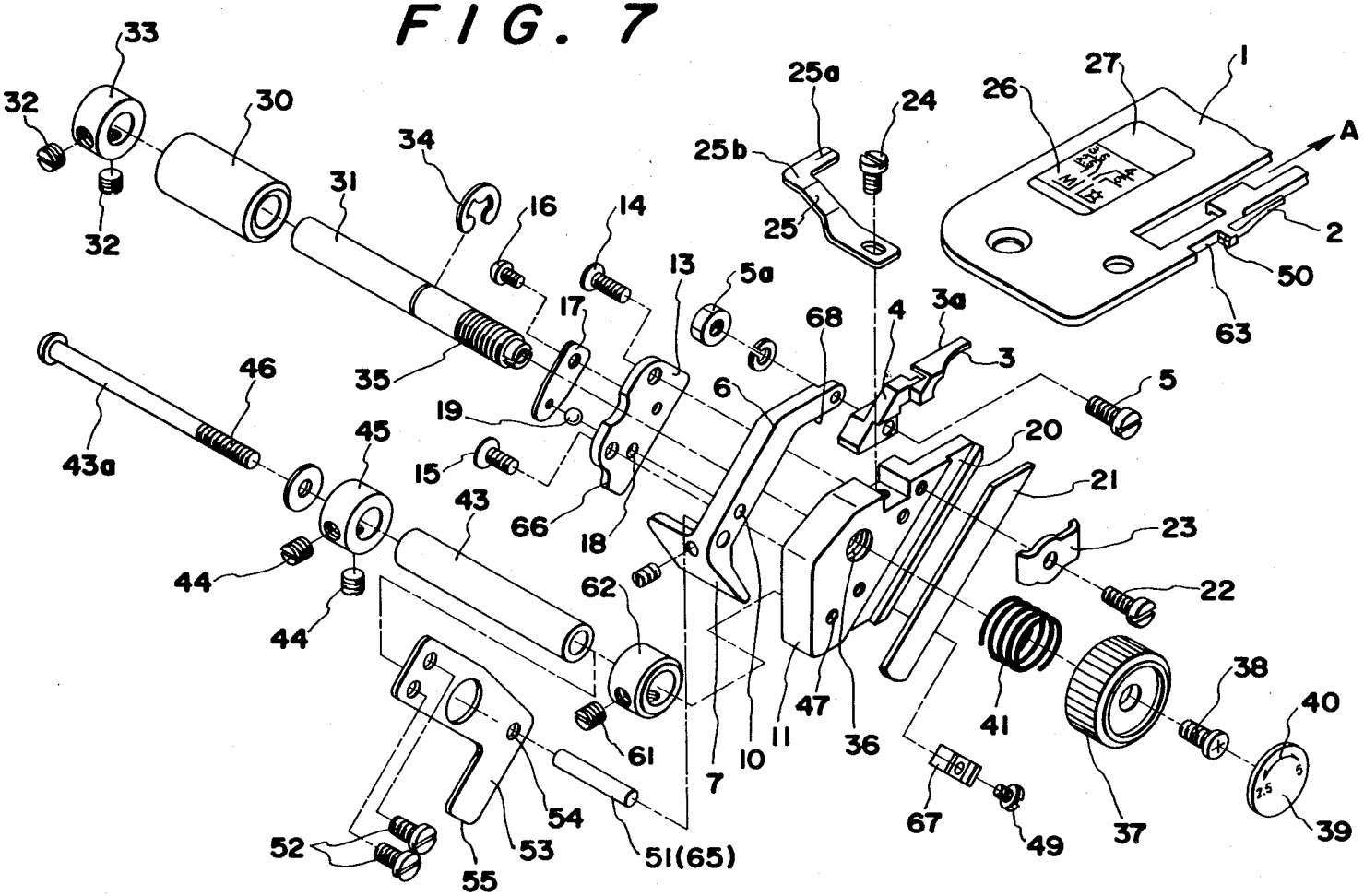
FIG. 7 is an exploded perspective view of a looping width adjusting mechanism.

Referring to the drawings, a stationary claw 2 directed in the direction A of feed of the cloth is extended along the needle-side of a throat plate 1. A movable claw 3 directed in the same direction as the direction A of feed of the cloth is arranged in a side-by-side relation to the stationary claw 2. An extension 3*a* directed towards the upper side of the stationary claw 2 is formed on an upper portion of the movable claw 3 integrally with the latter. When the looping width defined by the distance between the stationary claw 2 and the movable claw 3 is small, the extension 3*a* covers the upper side of the stationary claw 2, whereas, when the looping width is large, it extends between the stationary claw 2 and the movable claw 3. A mounting block 4 is secured to the rear end of the movable claw 3 as a unit with the latter. A movable member 6 is fixed to the mounting block 4 and is locked by means of a nut 5*a* (see FIG. 6).

Figure 1:
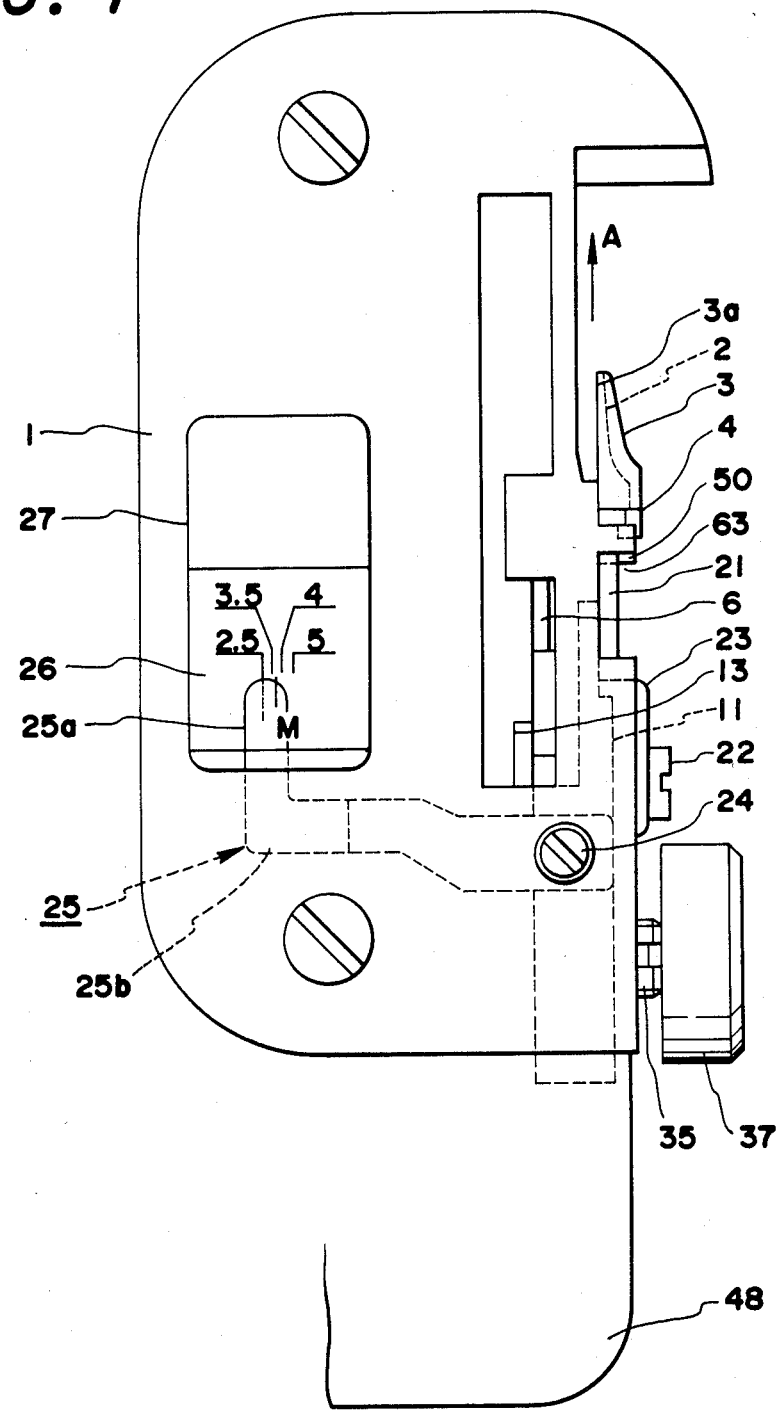
FIG. 1 is a plan view of the throat plate of an overlock sewing machine embodying the present invention.
Figure 2:
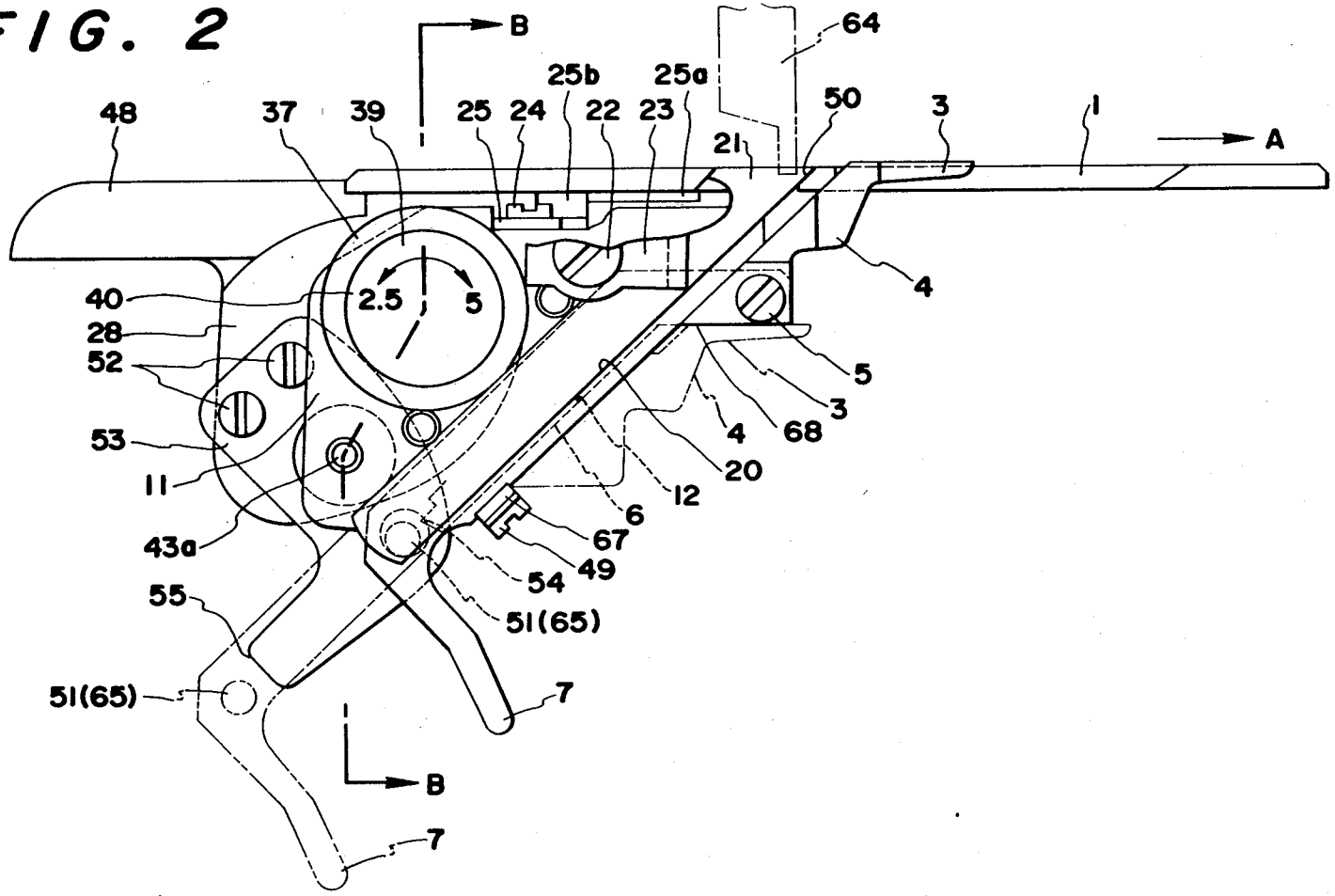
FIG. 2 is a right-side elevational view of the machine shown in FIG. 1.
Figure 3:
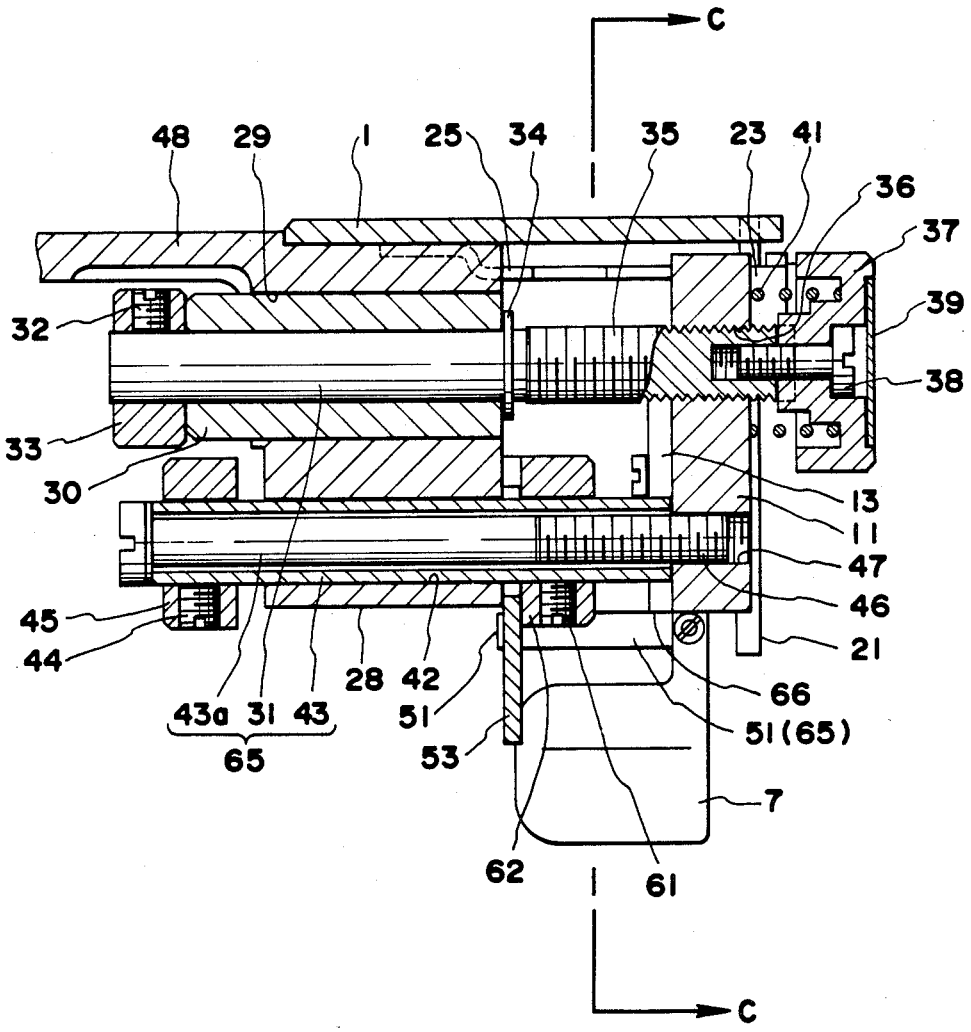
FIG. 3 is a sectional view taken along the line B—B of FIG. 2.

The connection of the movable member 6 to the mounting block 4 is made under such a condition that, while the movable claw 3 takes the operative position, the extension 3*a* thereof correctly covers the upper surface of the stationary claw 2. After the connection, the movable member 6 is immovable with respect to the mounting block 4 because, after the connection, both members are locked to each other. A second engaging portion 68 (see FIG. 2) is formed on the lower end of the portion of the movable member 6 where the mounting block 4 integral with the movable claw 2 is secured.

Figure 4:
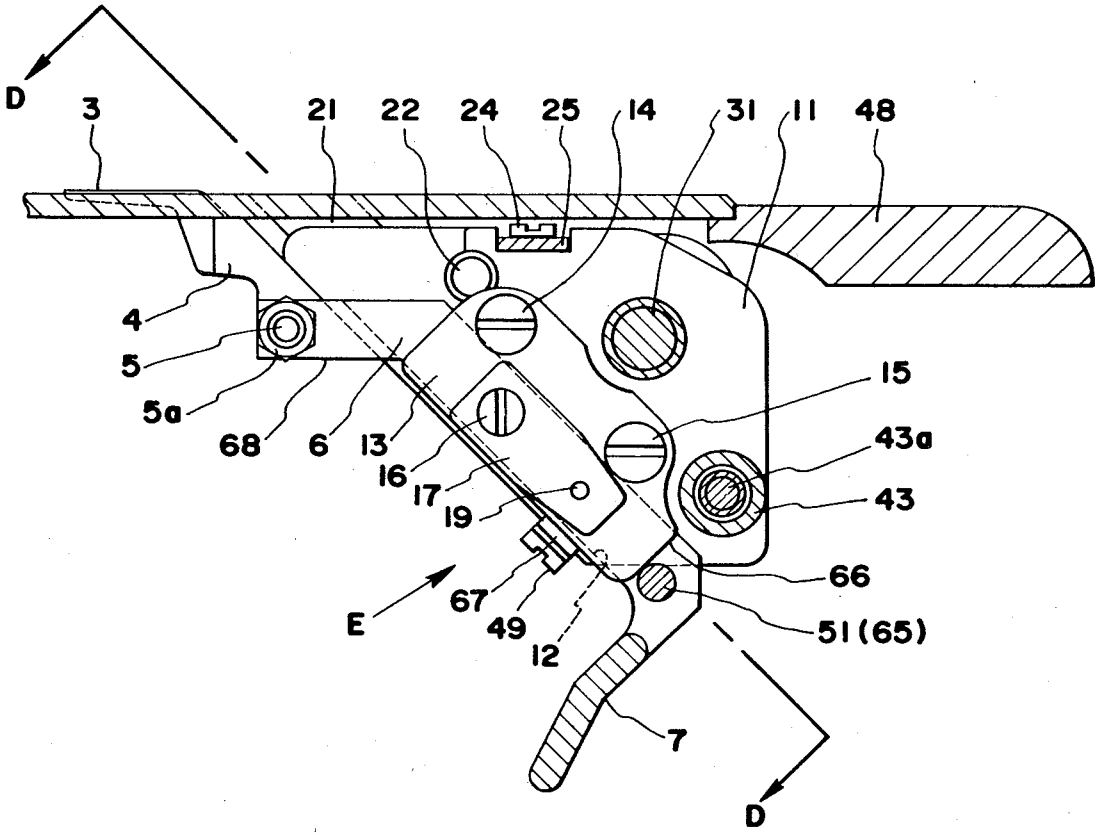
FIG. 4 is a sectional view taken along the line C—C of FIG. 3.
Figure 5:
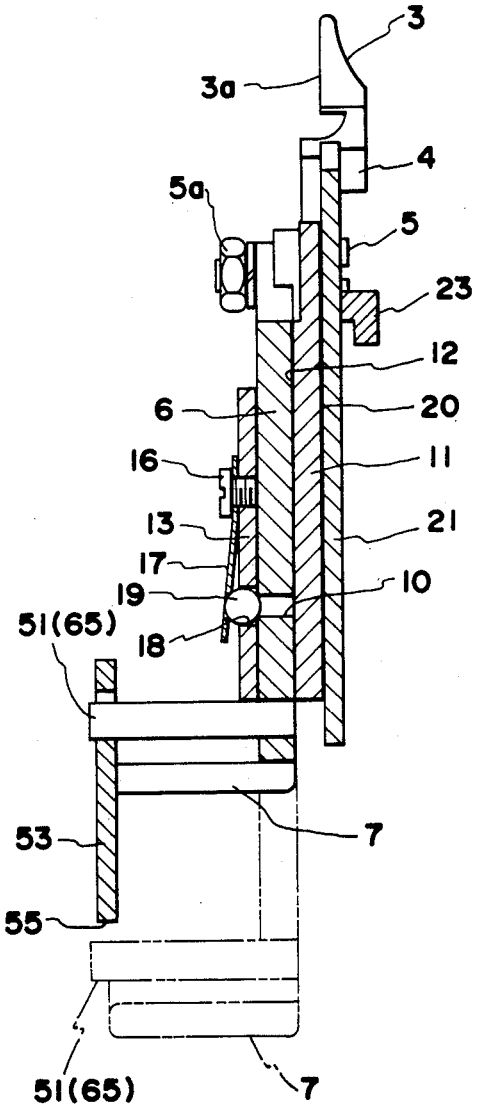
FIG. 5 is a sectional view taken along the line D—D of FIG. 4.

On the other hand, a finger retainer 7 is formed on the rear end of the movable member 6 as a unit with the latter. As shown in FIG. 5, the movable member 6 is provided at its lower portion with a positioning hole 10. This movable member is attached to the left side surface of the cutter blade holder 11 as viewed in the direction A of feed of the cloth. Namely, as will be seen from FIGS. 2, 4 and 5, an oblique guide groove 12 having an upper end directed forwardly, i.e. in the direction A of feed of cloth, and a lower end directed rearwardly, i.e. in the opposite direction to the direction A of feed of the cloth, is formed in the above-mentioned side surface of the cutter blade holder 11. The movable member 6 engages with this guide groove 12 for movement along the latter.

Furthermore, the movable member 6 is provided at its side opposite to the cutter blade holder 11 with a retainer plate 13. The retainer plate 13 is fastened to the cutter blade holder 11 by means of bolts 14 and 15 so as to prevent the movable member 6 from coming off from the guiding groove 12. A leaf spring 17 is fixed by means of a bolt 16 to the retainer plate 13. A ball 19 disposed in a through hole 18 is urged by the leaf spring 17 into contact with the movable member 6. As the movable member 6 moves upwardly, the ball engages with the hole 10 in the movable member 6 to locate the movable member 6 at the upper position which corresponds, as will be detailed later, to the operative position of the movable claw 3.

A pin 51 is formed to project from a portion of the movable member 6 adjacent to the finger retainer 7. In this embodiment, the pin 51 serves also as a first engaging portion 65. The pin 51 projects to the left from the movable member 6 as viewed in the direction of feed A of the cloth. A stationary plate 53 is fixed to the machine body 28 by means of a bolt 52 so as to confront the end of the pin 51. A hole 54 is formed in a portion of the stationary plate 53 located on the extension of the pin 51 when the movable member 6 takes the upper position. When the movable member 6 takes the lower position, the pin 51 faces the rear end edge 55 of the stationary plate 53. The length of the pin 51 is selected such that, when the extension 3*a* of the movable claw 3 laps the upper surface of the stationary claw 2, the pin 51 engages with the hole 54 or the rear end edge 55, while, when the extension 3*a* is spaced apart from the stationary claw, the pin 51 is deviated from the hole 54 or the rear end edge 55 to the right as viewed in the direction A of feed of the cloth. Thus, when all or a part of the extension 3*a* laps the upper surface of the stationary claw 2, the pin 51 or the hole 54 is held in engagement with the rear end edge 55.

The retainer plate 13 is fixed to the cutter blade holder 11 as explained before so that it constitutes, in combination with the cutter blade holder 11, a member which is immovable in the direction of movement of the movable claw 3 between the operative position and the inoperative position. The retainer plate 13 is provided at its lower end with an engaging receiving portion 66 for engagement with the pin 51 which constitutes the first engaging portion 65. When the movable claw 3 is in the operative position, the engaging receiving portion 66 is contacted by the pin 51 from the lower side to forcibly prevent any further upward movement of the movable claw 6. When the pin 51 is engaged by the engaging receiving portion 66, the ball 19 engages with the hole 10 in the movable member 6 by the resilient force of the leaf spring 17 so as to prevent the movable member 6 from moving downward, as explained before.

A mounting groove 20, which is inclined substantially at 45° and having higher forward end and lower rearward end as in the case of the guide groove 12 is formed in the right side surface of the cutter blade holder 11 as viewed in the direction of feed of the cloth. A lower cutter blade 21 engages with this mounting groove 20. More specifically, the lower cutter blade 21 is pressed and retained in the mounting groove 20 by means of a cutter blade retainer 23 which in turn is fixed to the cutter blade holder 11 by means of a bolt 22. In this state, the right side edge of the lower cutter blade 21 and the right edge of the movable claw 3 are aligned substantially in the direction A of feed of the cloth.

A pointer 25 is fixed by a bolt 24 to the upper side of the cutter blade holder 11 at a position ahead of a later-mentioned supporting means by which the cutter blade holder 11 is fixed to the machine body 28 and aback from the position of contact between the upper cutter blade and the lower cutter blade. The end 25*a* of the pointer 25 confronts the scale 26 of the throat plate 1. The pointer 25 is constituted by a leaf spring which is bent at its flat portion into a form like L with its one end fixed to the cutter blade holder 11 as stated above. The portion of the pointer 25 between the bend 25*b* and the other end 25*a* is held in pressure contact with the lower side of the throat plate 1 so that it urges the throat plate 1 so as to press the throat plate 1 upwardly. The throat plate 1 is fixed to the machine body 28 so as to resist to the biasing force exerted by the pointer 25. Therefore, the bolt 24 of the cutter blade holder 11 is urged downwardly by the reactional force produced by the pointer 25. The point of fixation of the pointer 25 to the cutter blade holder 11 by the bolt 24 is located at the forward side of the above-mentioned supporting means so that the portion of the cutter blade holder 11 ahead of the supporting means is urged downwardly by the pointer 25.

The scale 26 mentioned before is marked in the lighting transparent plate 27 provided in the throat plate 1. The end 25*a* of the pointer 25 confronts the lower side of the transparent plate 27 so that the present looping width is indicated by the pointer 25 in relation to the scale 26.

The machine body 28 is provided with a horizontal bore 29 which extends at a right angle to the direction A of feed of the cloth. A metal bushing 30 constituting a bearing is fixed in the bore 29 by means of a bolt. An operation shaft 31 is rotatably received by the metal bushing 30. A collar 33 is fixed by a bolt 32 to the left end of the operation shaft 31 as viewed in the direction A of feed of the cloth so as to contact the left end surface of the bushing 30. A stopper ring 34 fixed to the right end of the operation shaft 31 as viewed in the direction A of feed of the cloth prevents the operation shaft from coming out of the bushing 30. The portion of the operation shaft 31 located at the right side of the bushing 30 as viewed in the direction A of feed of the cloth has a screw thread 35 which is screwed into the female screw 36 of the cutter blade holder 11. A circular dial 37 is fixed by a bolt 38 to the right end portion of the operation shaft 31 at the right side of the cutter blade holder 11 and the surface of the dial 37 is covered by a decorative plate 39. The operation shaft 31 and the dial 37 are provided at their opposing surfaces with mating projection and recess so that they can rotate as a unit with each other. A mark 40 indicating the direction of rotating of the dial 37 is provided on the decorative plate 39. The cutter blade holder 11 is normally biased to the left by a compression spring 41 fitting around the operation shaft 31 and acting between the dial 37 and the cutter blade holder 11.

The machine body 28 is provided also with a bore 42 extending in parallel with the aforementioned bore 29 and movably receives a tubular supporting shaft 43. The position of the tubular supporting shaft 43 is adjustable by means of a holding bolt 43*a*. A collar 45 is fixed by means of a bolt 44 to the left end of the supporting shaft 43 as viewed in the direction A of feed of the cloth. The collar 45 serves as a stopper for preventing rightward movement of the supporting shaft 43. The leftward movement of the supporting shaft 43 is prevented by another collar 62 which is fixed to the right end of the supporting shaft 43 by means of a bolt 61. The screw thread 46 on the right end of the holder bolt 43*a* holding the supporting shaft 43 is screwed to a female screw 47 formed in the cutter blade holder 11. Thus, the cutter blade holder 11 is carried by the machine body 28 by means of the operation shaft 31 and the supporting shaft 43. Thus, the supporting means through which the mes holder 11 is supported by the machine body 28 is constituted mainly by the shafts 31,43 and the holder bolt 43*a*.

In the drawings, a reference numeral 48 designates a machine bed, while 67 denotes a stopper member which is fixed to the cutter blade holder 11 by a bolt 49. When the movable member 6 is moved downwardly to switch the movable claw 3 to the inoperative position, the second engaging member 68 on the lower side of the bent upper portion of the movable member 6 abuts the stopper member 67 to prevent any excessive movement of the movable member 6 and, hence, of the movable claw 3. Since the movable claw 3 does not contact the engaging receiving portion 66 nor the stopper member 67, the initial condition of fixing of the movable claw 3 to the movable member 6 is maintained even though the movable member 6 is moved by a strong force.

A reference numeral 50 denotes a cutter blade receiving portion constituted by a slant surface. The cutter blade receiving portion 50 is formed in the needle side of the throat plate 1 at the rear side of the stationary claw 2, i.e. at the forward side as viewed in the direction A of feed of the cloth, on the forward side of a guide groove 63 which opposes to the aforementioned mounting groove 20 in the cutter blade holder 11. Therefore, the guide groove 63 extends obliquely with its upper end directed forwardly and with its lower end directed rearwardly as viewed in the direction A of feed of the cloth as is the case of the mounting groove 29. As the lower cutter blade 21 is commonly received by the mounting groove 20 in the cutter blade holder 11 and the guide groove 63 in the throat plate 1, the lower portion of the edge of the lower cutter blade 21 contacts the cutter blade receiving portion 50 so as to be supported by the latter from the lower side. An upper cutter blade 64 moves up and down to make sliding contact with the lower cutter blade 21 so that the sawn material is cut and trimmed by the cooperation between two cutter blades 21 and 64.

The operation of the overlock sewing machine of the invention will be described hereinunder.

In the following description, the definition of the direction such as forward, rearward, upward, downward, leftward and rightward is made in relation to the direction A of feed of the cloth which is an example of the sewn material. The looping width of the overlock is determined by the distance between the left side of the stationary claw 2 and the right side of the movable claw 3 in the inoperative position (position shown by full line in FIG. 2). The looping width can be adjusted by moving the movable claw 3 to the left and right. This can be achieved by rotating the dial 37. The looping width formed by the stationary claw 2 and the movable claw 3 is adjustable within the range of between 2.5 mm and 5.0 mm. More specifically, the looping width is increased as the dial 37 is rotated clockwise and is decreased as the same is rotated counter-clockwise, as will be understood by reference to the mark 40 put on the dial 37.

The extension 3*a* overlaps the upper side of the stationary claw 2 permitting the stationary claw 3 to approach the stationary claw 2 when the looping width is small. On the other hand, when the looping width is large, the extension 3*a* of the movable claw 3 extends towards the stationary claw 2 to reduce the gap between the stationary claw 2 and the movable claw 3, so that the cloth is supported by the extension 3*a* during the overlock operation. Thus, the undesirable dropping of the cloth into the gap between the stationary claw 2 and the movable claw 3 can be advantageously avoided.

As the dial 37 is rotated in either direction, the operation shaft 31 rotates as a unit with the dial 37 so that the cutter blade holder 11 which makes a screwing engagement with the thread 35 of the operation shaft 31 is moved either to the left or right. The stopper ring 34 and the collar 33 serve to prevent the operation shaft 31 from moving in the axial direction so that the operation shaft makes only rotational motion. Thus, the operation shaft 31 which makes only the rotational motion and the cutter blade holder 11 held in screwing engagement with the screw thread 35 on the operation shaft 31 combine to constitute a conversion means which converts the rotation of the dial into a forward and backward linear motion of the cutter blade holder 11. The supporting shaft 43 moves as a unit with the cutter blade holder 11 as the latter moves. When the cutter blade holder 11 has been moved to the right stroke limit thereof, the collar 45 contacts the machine body 28 to stop further rightward movement of the cutter blade holder 11. When the cutter blade holder 11 has reached its stroke limit during its leftward movement, the collar 62 abuts the stationary plate 53 to prevent further leftward movement of the cutter blade holder 11. Thus, cutter blade holder 11 is always supported on the machine body 28 through the supporting means 65 constituted by the operation shaft 31, supporting shaft 43 and so forth.

The movement of the cutter blade holder 11 is accompanied by the movement of the movable member 6 and, hence, of the movable claw 3 so that the looping width is varied and adjusted. At the same time, the pointer 25 which moves together with the cutter blade holder 11 indicates the looping width on the scale 26. The movement of the pointer 25 is made while the portion thereof forward of the bend 25*b* makes sliding contact with the lower side of the throat plate 1. Namely, the bend 25*b* of the pointer 25 is maintained in a pressure contact with the throat plate 1, so that the pointer 25 produces a spring force which acts to downwardly bias the portion of the cutter blade holder 11 ahead of the supporting means. Since the portion of the cutter blade holder 11 ahead of the supporting means is biased downwardly, the undesirable oscillation of the front portion of the cutter blade holder 11 during the sliding contact between the upper and lower cutter blades is remarkably suppressed.

In the described embodiment of the invention, in order to cause the cutter blade holder 11 to move to the left and right, the operation shaft 31 is screwed to the cutter blade holder 11. Since this screwing engagement involves a backlash, the connection between the cutter blade holder 11 and the operation shaft 31 is not rigid. The fixation of the cutter blade holder 11 to the machine body 28 is also not rigid due to gaps allowing the cutter blades holder 11 to move to the left and right formed between the walls of the bores 29,42 in the machine body 28 and the operation shaft 31 and the tubular supporting shaft received by these bores.

Even though the previously mentioned connections back rigidity, the vertical oscillation of the cutter blade holder 11 is effectively prevented because the pointer 25, made of a spring-like resilient member, acts to urge the front portion of the cutter blade holder downward forcing the end of the lower cutter blade 21 be seated on the cutter blade receiving portion 50 of the throat plate 1. This in turn prevents the vertical oscillation of the lower cutter blade 21 and the movable claw 3 supported by the cutter blade holder 11.

It has been found that the amplitude of the vertical oscillation of the lower cutter blade 21 is 0.3 mm when the pointer 25 made from a spring-like resilient member is not employed. However when the pointer 25 is employed in the present invention, the oscillation amplitude is reduced to a value within the range between 0.007 and 0.013 mm. Such a small oscillation amplitude does not impose any practical inconvenience. However, if the thickness of the pointer 25 is increased to increase its spring constant or rigidity, the friction between the pointer 25 and the throat plate 1 becomes excessively large, hindering the movement of the cutter blade holder 11 to the left and right.

The cutter blade holder 11 is normally biased to the left by the coiled spring 41 so that any backlash in the screwing engagement between the operation shaft 31 and the cutter blade holder 11, does not cause play of the cutter blade holder 11 in the left and right direction.

The movement of the cutter blade holder 11 causes a movement of the lower cutter blade 21 which is unitary with the cutter blade holder 11, so that the relative position between the lower cutter blade 21 and the movable claw 3 is never changed. The position of cutting of the cloth is also changed in accordance with a change in the looping width. The lower side of the blade of the lower cutter blade 21 is supported by the cutter blade receiving portion 50 of the throat plate 1 from the lower side thereof, so that the load during the cutting of the cloth is born not only by the supporting means for the cutter blade holder 11 but also by the cutter blade receiving portion 50 of the throat plate 1. Namely, the load is shared by the cutter blade holder 11 and the throat plate 1. It is, therefore, possible to remarkably decrease the level of the load repeatedly imposed on the supporting means through which the cutter blade holder 11 is supported by the machine body 28. It is, therefore, possible to prevent any reduction in the supporting force of the supporting means and to avoid any deformation of the member constituting the supporting means. It is, therefore, possible to effect simply and smoothly the adjustment of the position of cutting of the cloth by the rotation of the dial, 37, without causing any play of the lower cutter blade or the cutter blade holder 11.

With the overlock sewing machine of the present invention, it is possible to effect the overlock solely by the stationary claw 2 without assistance by the movable claw 3. In this case, however, the looping width is extremely small because the overlock is made solely over the width of the stationary claw 2. In this case, the movable claw 3 takes a retracted lower position, i.e. the inoperative position indicated by broken line in FIG. 2. The movement of the movable claw 3 to this position is made in the following procedure. Namely, the movable claw 3 is first moved to the right to separate its extension 3*a* from the upper side of the stationary claw 2. This is accomplished by moving the cutter blade holder 11 to the right by the rotation of the dial 37.

In consequence, the end of the pin 51 of the movable member 6 is disengaged from the hole 54 in the stationary plate 53, so that the movable member 6 is freed to move back and forth. Therefore, the downward movement of the movable member 6 is caused by pulling the same downwardly by a finger retained by the finger retainer 7 on the movable member 6. Consequently, the movable member 6 is lowered along the guide groove 12 so that the second engaging portion 68 where the mounting block 4 integral with the movable claw 3 is fixed abuts the stopper 67 to stop the downward movement of the movable member 6 and the movable claw 3 at the position shown by the broken line in FIG. 2, i.e. at the inoperative position.

Although in the described embodiment the stopper member 67 is provided on the cutter blade holder 11, it is, of course, possible to mount the stopper member 67 on another member which does not move between the operative position and the inoperative position, e.g. the stationary plate 53, machine frame 28 and so forth.

For effecting an overlock with extremely small looping width as mentioned before, the dial 37 is rotated to move the cutter blade holder 11 to the leftmost end, thereby positioning the lower cutter blade 21 in the position closest to the throat plate 1. In this state, the point of cutting of the cloth is located on the same line as the right side edge of the stationary claw 2 so that the overlock sewing is conducted with the minimum looping width. Similarly, by moving the cutter blade holder 11 to the right from the position of the extremely small looping width mentioned above while leaving the movable claw 3 at the inoperative position, the width of cutting of the cloth is broadened although the looping width is still extremely small. In this state, therefore, the cloth is overlocked in such a manner as to wrap the stationary claw 2. This is the overlock sewing so-called wrap-lock. Thus, according to the invention, it is possible to freely adjust the looping width and, in addition, to effect a wrap overlock sewing simply by the rotation of the dial 37 and the movement of the movable member 6.

As the cutter blade holder 11 is moved to the left while the movable claw 3 is in the inoperative position, the end of the pin 51 on the movable member 6 is moved to the position behind the rear edge 55 of the stationary plate 53. In this state, the movable member 6 is locked against the back and forth movement as in the case where the end of the pin 51 has come into the hole 54 in the stationary plate 53.

Namely, when the end of the pin 51 is held in this position, the cutter blade holder 11 has been moved to the left so that the stationary claw 2 is located on the path of movement of the extension 3*a* of the movable claw 3. If the movable member 6 is moved back and forth in this state, the extension 3*a* will interfered by the stationary claw 2. According to the invention, therefore, the movable member 6 is locked in this state against the movement of the movable member 6 so as to prevent the interference between the extension 3*a* and the stationary claw 2 thereby preventing the breakdown of the extension 3*a* and the stationary claw 2. When the end of the pin 51 has been moved to the right, away from the hole 54 and the rear end edge 55, the path of movement of the movable claw 3 and the extension 3*a* is deviated to the right from the stationary claw 2 to avoid the interference between the extension 3*a* and the stationary claw 2. In this state, it is possible to move the movable member 6 freely up and down and to move the movable claw 3 between the operative position and the inoperative position.

To reset the movable claw 3 to the operative position, the end of the pin 51 is spaced from the hole 54 and the rear end edge 55 and the finger retainer 7 is moved upward.

Consequently, the movable member 6, mounting block 4 and the movable claw 3 are moved upward to the operative position. As the operative position is reached, the ball 19 is aligned with the hole 10 in the movable member 6 to drop into the hole 10 while the pin 51 constituting the first engaging portion 65 abuts the engaging portion 66 of the retainer plate 13. The movable member 6 cannot be fixed by the ball 19 solely because, since the ball 19 is biased into the hole 10 merely by the force of the leaf spring 17. Namely, if the movable member 6 is moved by a force which is large enough to overcome the biasing force exerted by the leaf spring 17, the movable member 6 will be moved further while forcing the ball 19 out of the hole 10. According to the described embodiment, however, this further movement of the movable member 6 is prevented because the pin 51 abuts the engaging receiving portion of the retainer plate 13. Thus, the movable member 6 is forcibly stopped at the operative position so that the movable claw 3 is correctly set in the operative position.

In the described embodiment, the pin 51 which constitutes a safety mechanism for avoiding the interference between the extension 3*a* of the movable claw 3 and the stationary claw 2 also serves as the first engaging portion 65. This arrangement, however, is not essential and the first engaging portion 65 may be formed separately from the pin 51, on the movable member 6 or a member which moves as a unit with the latter. Needless to say, the engaging portion 66 may be provided on members other than the described retainer plate 13 which do not move between the operative position and the inoperative position, e.g. the stationary plate 53 or the machine body 28.

As has been described, according to the invention, a first engaging portion and a second engaging portion are formed on the moving movable member. A member which does not move following the switching movement of the movable member is provided at its portion confronting the path of movement of the movable member with an engaging receiving portion adapted to be engaged by the first engaging portion during the movement of the movable claw from the inoperative position to the operative position so as to locate the movable claw at the operative position and also with a stopper member adapted to be engaged by the second engaging portion during the movement of the movable claw from the operative position to the inoperative position so as to locate the same at the inoperative position. Therefore, even when the movable claw is moved from the inoperative position to the operative position by a strong force, the first engaging portion is forcibly checked by the engaging receiving portion so that the movable claw is correctly set at the operative position. On the other hand, even if the movable claw is moved by a large force from the operative position to the inoperative position, the undesirable excessive movement of the movable claw is prevented because the second engaging portion is contacted by the stopper member. Consequently, the movable claw can be correctly set at the inoperative position and the condition of connection between the movable member and the movable claw is never impaired. According to the invention, therefore, it is possible to attain an overlock sewing of an attractive appearance with a high uniformity of the seam, because the looping width determined by the positions of the movable claw and the stationary claw is never fluctuated due to the fact that the movable claw can be precisely held at the adjusted position in relation to the stationary claw.

Furthermore, since the dial and the conversion means for converting the rotary motion of the dial into the linear motion are associated with the cutter blade holder, these members are mounted sufficiently stably and rigidly in view of the relationship between the mes holder and the machine body which are inherently rigid and stable. Therefore, the movable claw can be held rigidly to avoid any influence by the cutter blade operation pressure and the vibration, without necessitating any specific fixing means.

What is claimed is:

1. An overlock sewing machine having a machine body comprising: a looping width adjusting mechanism having a throat plate over which a cloth is fed and a stationary claw integral with said throat plate and directed in the direction of movement of the feed of said cloth; a movable claw separate from said throat plate and disposed in a side-by-side relation to said stationary claw and directed in the same direction as said stationary claw; a cutter blade holder mounted on the machine body and carrying said movable claw such that said movable claw can be moved towards and away from the side of said stationary claw; a lower cutter blade carried by said cutter blade holder; an upper cutter blade disposed for sliding contact with said lower cutter blade; a movable member having a finger retainer and movably mounted on said cutter blade holder so as to cause the movement of said movable claw between an operative position adjacent to the side of said stationary claw and an inoperative position spaced away from said side of said stationary claw; a dial having rotary motion and a conversion means for converting a rotary motion of said dial into a linear motion thereby causing the movement of said movable claw toward and away from the side of said stationary plate; wherein the improvement comprises that said dial and said conversion means are associated with said cutter blade holder so as to cause a movement of said cutter blade holder, whereby the adjustment of the distance between said stationary claw and said movable claw is effected by a linear movement of said cutter blade holder in the direction perpendicular to the direction of feed of said cloth caused by a rotation of said dial.

2. The overlock sewing machine defined in claim 1, wherein said cutter blade holder is movably carried by the machine body through a plurality of shafts.

3. The overlock sewing machine defined in claim 1, wherein said dial is disposed at the opposite side of said cutter blade holder to the machine body as viewed in the direction perpendicular to the direction of feed of the cloth.

4. The overlock sewing machine defined in claim 1, wherein said movable member has a first engaging portion and a second engaging portion, and wherein a member which does not move in the direction of movement of the movable member is provided at its portion confronting the path of movement of said movable member with an engaging receiving portion adapted to be engaged by said first engaging portion so as to prevent excessive movement of said movable member thereby to locate said movable claw at said operative position and with a stopper member adapted to be engaged by said second engaging portion so as to prevent the excessive movement of said movable member thereby to locate said movable claw at said inoperative position during the movement of said movable claw from said operative position to said inoperative position.

5. The overlock sewing machine defined in claim 1, wherein a spring-like resilient member is interposed between said throat plate and said cutter blade holder so as to biasingly position said cutter blade holder with respect to said throat plate.

6. The overlock sewing machine defined in claim 1, wherein the position at which said upper cutter blade and said lower cutter blade make sliding contact and the position at which said cutter blade holder is supported on said machine body are offset from each other in the direction of feed of the cloth, and wherein a spring-like resilient member is disposed between said throat plate and said cutter blade holder so as to biasingly position said cutter blade holder with respect to said throat plate.

7. The overlock sewing machine defined in claim 1, wherein the looping width is indicated by a cooperation between a pointer and a scale, said pointer being constituted by a spring-like resilient member fixedly carried by said cutter blade holder so as to act between said cutter blade holder and said throat plate so as to biasingly position said cutter blade holder with respect to said throat plate.

8. The overlock sewing machine defined in claim 1, wherein said throat plate is provided with a lighting window closed by a transparent plate provided with a scale which is adapted to cooperate with a pointer in indicating the present looping width, said pointer being constituted by a spring-like resilient member fixed to said cutter blade holder and confronting said lighting window from the reverse side of said throat plate so as to act between said cutter blade holder and said throat plate to bias said cutter blade holder.

9. The overlock sewing machine defined in claim 1, wherein said throat plate is provided with a cutter blade receiving portion for supporting an upper portion of said lower cutter blade from the lower side of said lower cutter blade.

10. The overlock sewing machine defined in claim 1, wherein one of said stationary claw and said movable claw is provided with an extension which is adapted to lap the other of said stationary claw and said movable claw.

11. The overlock sewing machine defined in claim 1, wherein either one of said stationary claw and said movable claw is provided with an extension adapted to lap the other of said stationary claw and said movable claw, and wherein one of said movable member held and guided by said cutter blade holder and a stationary part on said machine frame is provided with a projection projecting in the direction of movement of said cutter blade holder while the other has an engaging portion engageable with said projection, whereby said movable member can move back and forth only when the said cutter blade holder has been moved to disengage said engaging portion from said projection to keep said extension away from the lapping position.

12. The overlock sewing machine defined in claim 1 wherein a spring-like resilient member is interposed between said machine body and said cutter blade so as to biasingly position said cutter blade holder.

* * * * *